US005971726A

United States Patent [19]

Yoshida et al.

[11] Patent Number: 5,971,726

[45] Date of Patent: Oct. 26, 1999

[54] TUBE CONNECTOR RESTRICTION MEANS FOR A TUBE-TYPE ROLLER PUMP

[75] Inventors: Eiichi Yoshida, Hyogo; Hiroshi Tachibana, Shiga; Takehisa Nakayama; Yasufumi Hamanishi, both of Hyogo; Tokio Hirano; Tetsuya Ohshiba, both of Tokyo, all of Japan

[73] Assignee: Kaneka Corporation, Osaka, Japan

[21] Appl. No.: 08/897,950

[22] Filed: Jul. 24, 1997

[30] Foreign Application Priority Data

Jul. 25, 1996 [JP] Japan ..... 8-195130

[51] Int. Cl.[6] ..... F04B 43/08

[52] U.S. Cl. ..... 417/477.1; 417/476

[58] Field of Search ..... 417/477.1, 477.11, 417/477.9, 476

[56] References Cited

U.S. PATENT DOCUMENTS

| | | | |
|---|---|---|---|
| 3,756,752 | 9/1973 | Stenner | 417/477 |
| 4,184,815 | 1/1980 | Casson et al. | 417/477 |
| 4,187,057 | 2/1980 | Xanthopoulos | 417/477.11 |
| 4,976,590 | 12/1990 | Baldwin | 417/53 |
| 5,326,236 | 7/1994 | Kramer et al. | 417/476 |
| 5,533,877 | 7/1996 | Friedmann et al. | 417/477.1 |

FOREIGN PATENT DOCUMENTS 2 071 238 9/1971 France .

*Primary Examiner*—Charles G. Freay
*Assistant Examiner*—Cheryl J. Tyler
*Attorney, Agent, or Firm*—Armstrong, Westerman, Hattori, McLeland & Naughton

[57] ABSTRACT

In a tube type roller pump having a stator, an elastic tube to which two tube connectors are fixed at a predetermined interval, and a drawing roller, movement of the tube connectors is regulated by a regulating portion disposed on a main body that constitutes the stator. The tube type roller pump prevents separation and expansion of the elastic tube from the stator, and thus is small in discharge error.

2 Claims, 4 Drawing Sheets

TUBE CONNECTOR RESTRICTION MEANS FOR A TUBE-TYPE ROLLER PUMP

BACKGROUND OF THE INVENTION

The present invention relates to an improvement of a tube type roller pump used for injecting, e.g., a medicinal solution, and more particularly, to a pump with improved discharge accuracy.

An apparatus of plasma pheresis that removes harmful components such as cholesterol contained in blood employs a tube type roller pump for conveying the blood collected from a donor and the blood plasma separated into blood plasma and blood cell components by a blood plasma separator. An elastic tube constituting this pump is disposable since the elastic tube is contaminated by blood and the like every time it is used. Hence, it is required that an elastic tube be attached and detached with ease.

FIG. 2 is a perspective view showing the construction of an example of such tube type roller pump. In FIG. 2, reference numeral 1 denotes a main body that constitutes a stator; and 2, a rotor that is rotated about the center P of the shaft by a not shown drive means at a predetermined velocity. Pairs of regulating members 2*a* are disposed on both surfaces (the bottom surface is not shown) closer to the end portion of the rotor. The regulating members 2*a* in each pair are arranged at an interval that is wider than the outer diameter of an elastic tube that will be described later. Reference numeral 3 denotes a roller that is rotatably fixed to each of both ends of the rotor 2.

Reference numeral 4 denotes the elastic tube. Two tube connectors 5*a*, 5*b* respectively having collars 6*a*, 6*b* are attached to the elastic tube 4 at a predetermined interval so as to be watertight. Reference characters 7*a*, 7*b* denote notches formed at a lower portion of the main body 1 so as to be distanced at a predetermined interval. Each of these notches 7*a*, 7*b* is formed to have such a width as to allow the outer diameter of the tube 4 to be inserted thereinto and the corresponding collar 6*a* or 6*b* of the tube connector 5*a* or 5*b* to be engaged therewith. Reference numeral 8 denotes a pump cover that covers the rollers 3 and the tube 4.

In the aforementioned construction the elastic tube 4 is not only interposed between each of the pairs of regulating members 2*a* formed on the rotor 2, but also inserted into the notches 7*a*, 7*b*, and then the collars 6*a*, 6*b* on both ends of the tube connectors 5*a*, 5*b* are retained in the notches 7*a*, 7*b* of the main body while extending the elastic tube 4 along the inner surface of the stator 1 as shown in FIG. 3 (*a*). In this case, the distance between the inner diameter of the stator 1 and each roller 3 is adjusted to such a value as to allow the inner surfaces of the elastic tube 4 to come in contact with each other when the rotor 2 is rotated in a direction indicated by the arrow M.

Then, when the rotor 2 is rotated with one end of the tube 4 connected to, e.g., a donor, a predetermined quantity of blood, which is $(\pi d^2/4)\times L$), can be discharged every rotation of the rotor 2 (if it is assumed that the inner diameter of the tube is $\phi d$, and that the length of the tube partitioned by the rollers is L (nearly equal to (distance between the shaft center P of the rotor 2 and the axis of the tube $r\times\pi$)). Further, the used tube 4 is easily replaceable by removing the tube connectors 5*a*, 5*b* from the notches 7*a*, 7*b*.

Discharge of the thus constructed tube type roller pump fluctuates attributable to dimensional errors in the inner diameter of the tube and the length of the tube within the pump. Further, in the aforementioned pump movement of the connectors 5 disposed on both ends of the tube 4 is not regulated. Therefore, the tube 4 is pulled as the rotor 2 rotates as shown in FIGS. 3 (*b*) and (*c*). As a result, portions indicated by "A" and "B", for example, are separated from the inner wall of the stator 1, and one 5*b* of the tube connectors expands by a length indicated by "d" from the main body 1. Such expansion is also responsible for the error.

FIG. 4 shows how an exemplary discharge accuracy test was conducted using the aforementioned pump. The distance between the rollers and the stator is adjusted so that the delivery pressure of the pump was 2 kgf/cm$^2$ or more before starting the test with the distance between the shaft center of the rotor and the axis of a tube when the tube was set along the stator being 35 mm using the tube having an outer diameter of 10 mm and an inner diameter of 6.6 mm. The test result exhibited errors up to 25% with respect to the nominal discharge that is equal to 200 ml/min.

SUMMARY OF THE INVENTION

An object of the present invention is to provide a tube type roller pump having only a small error by preventing separation and expansion of the elastic tube from the stator.

To achieve the above object, the present invention is applied to a tube type roller pump that includes a stator, an elastic tube to which two tube connectors are fixed at a predetermined interval, and a drawing roller. In such tube type roller pump, movement of the tube connectors is regulated by a regulating portion disposed on a main body that constitutes the stator.

DETAILED DESCRIPTION OF A PREFERRED EMBODIMENT

Figure 1:
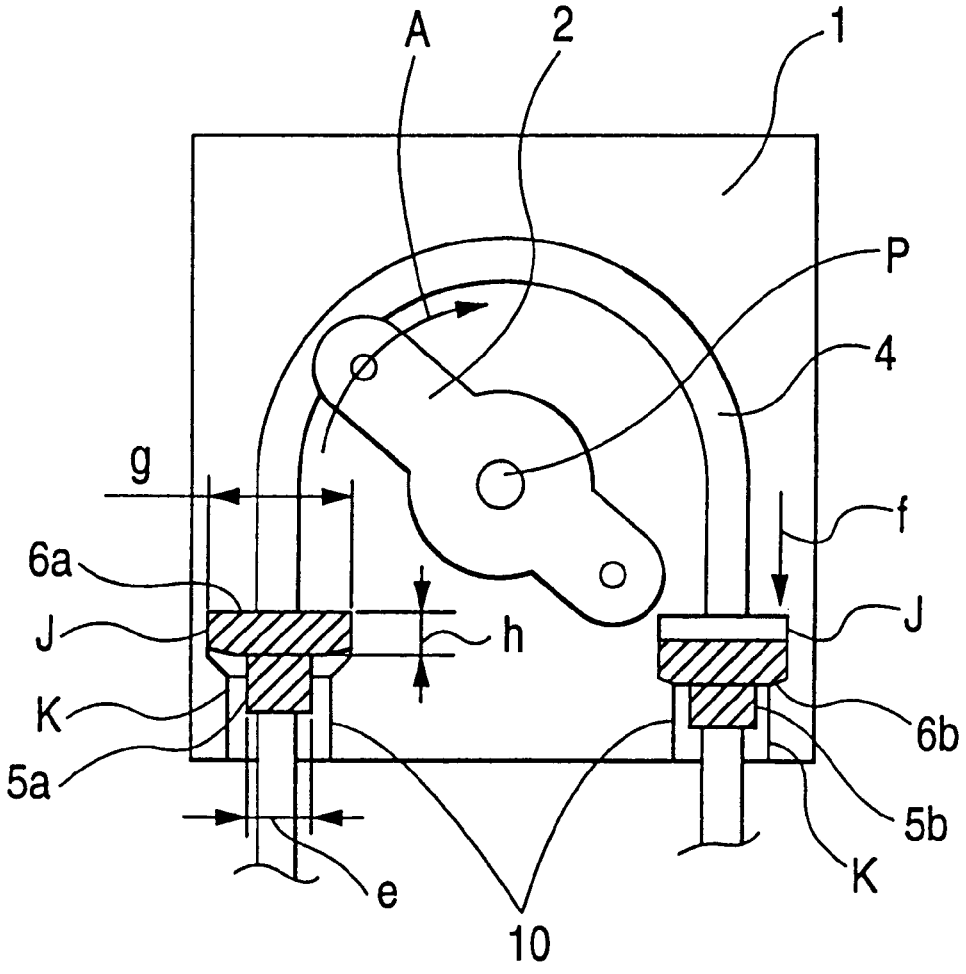
FIG. 1 is a diagram showing the construction of a main portion of a tube type roller pump, which is a mode of embodiment of the present invention.
Figure 2:
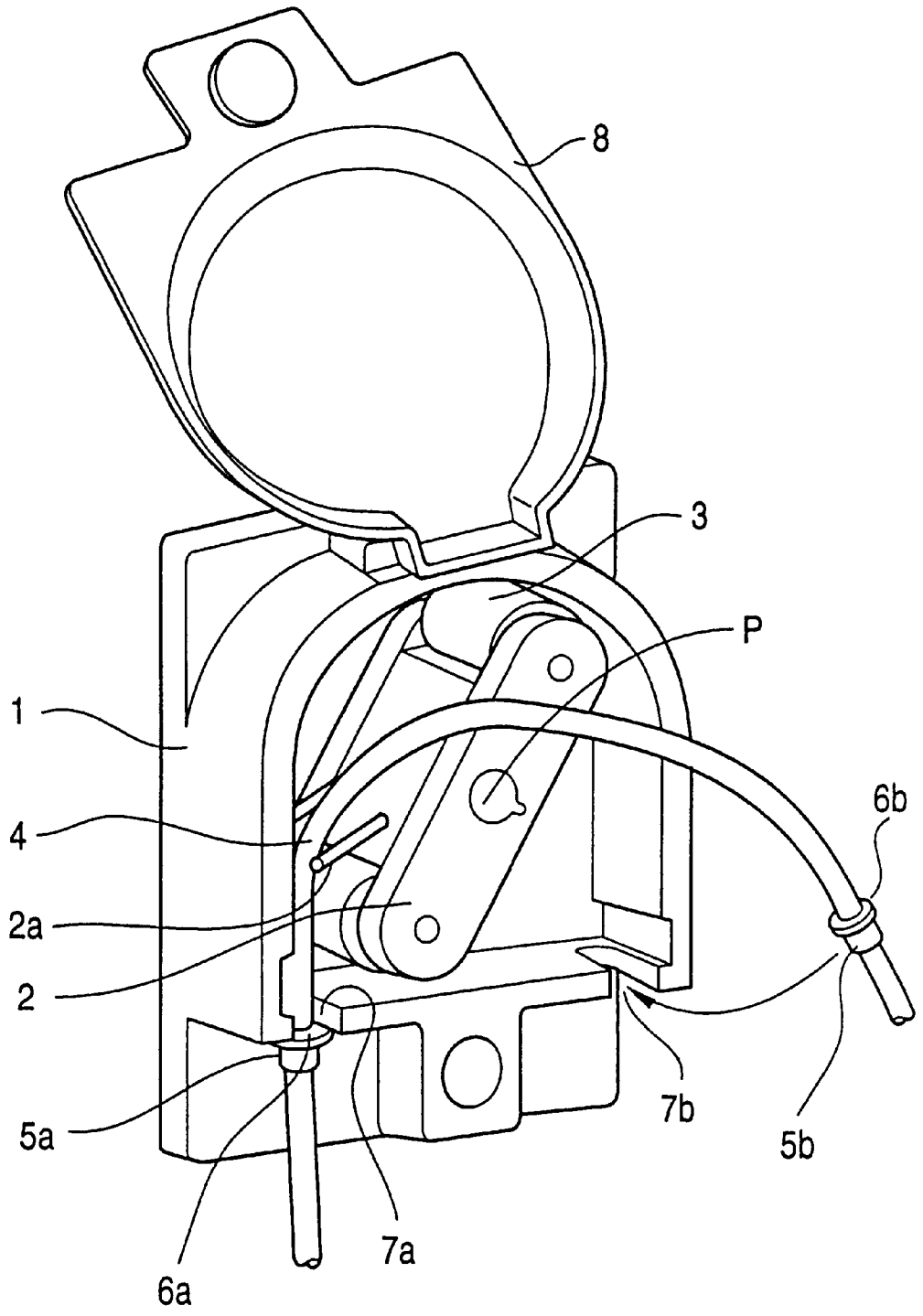
FIG. 2 is a perspective view showing the construction of a main portion of an exemplary prior art tube type roller pump.

FIG. 1 is a diagram showing the construction of a main portion of one mode of embodiment of the present invention. In FIG. 1, the same parts and components as those of FIG. 2 are denoted by the same reference numerals. What is distinguished from FIG. 2 is that grooves 10 are formed in the main body 1 and regulate movement of the tube connectors 5*a*, 5*b*. Portions above the grooves 10, which are denoted by "j", are formed slightly larger than the outer diameter "g" and thickness "h" of the collars 6*a*, 6*b* of the tube connectors 5*a*, 5*b*. Portions below the grooves 10, which are denoted by "k", are formed in the main body slightly larger than the small diameter portion "e" of the connectors. As a result of such construction, the entire part of the connectors 5*a*, 5*b* can be hidden into the grooves 10. When the pump cover 8 shown in FIG. 2 is closed with the connectors 5*a*, 5*b* inserted into the grooves 10, movement of the connectors is regulated.

Figure 3C:
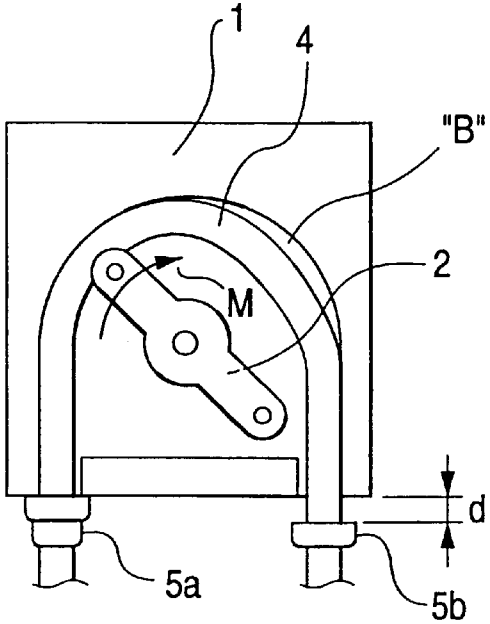
FIGS. 3A, 3B and 3C are diagrams illustrative of the movement of a tube and connectors in the exemplary prior art pump of FIG. 2.
Figure 3B:
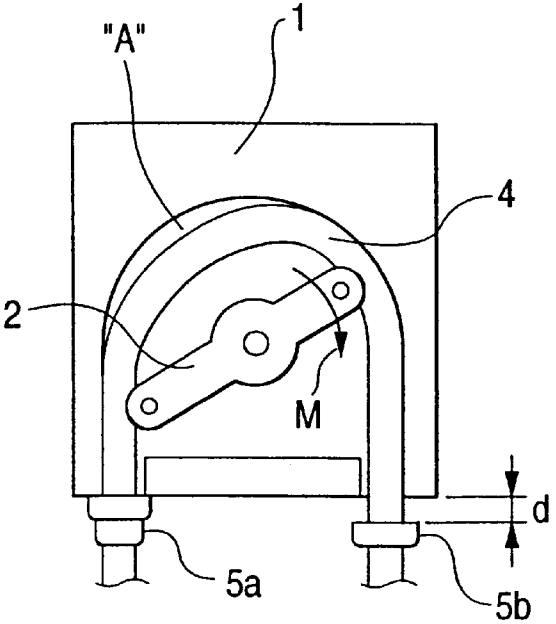
Figure 3A:
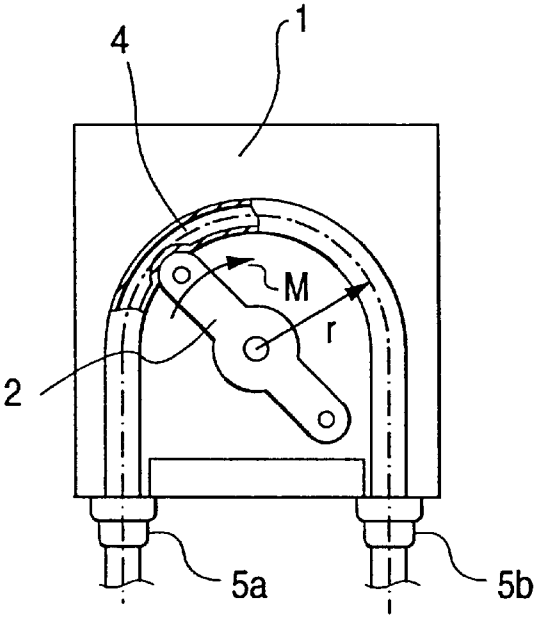

As a result of the aforementioned construction, even if the rotor 2 is rotated in a direction indicated by the arrow "A", not only is the tube 4 not separated from the inner wall of the stator 1 as shown in FIGS. 3B, 3C because since the movement of the collar 6*b* of one of the connectors is regulated by the corresponding groove 10, but also the entire part of the tube does not expand from the main body because the movement of the connector 5*b* in a direction indicated by the arrow "f" is regulated. In addition, the tube 4 can be attached and detached with ease as in the example.

Figure 4:
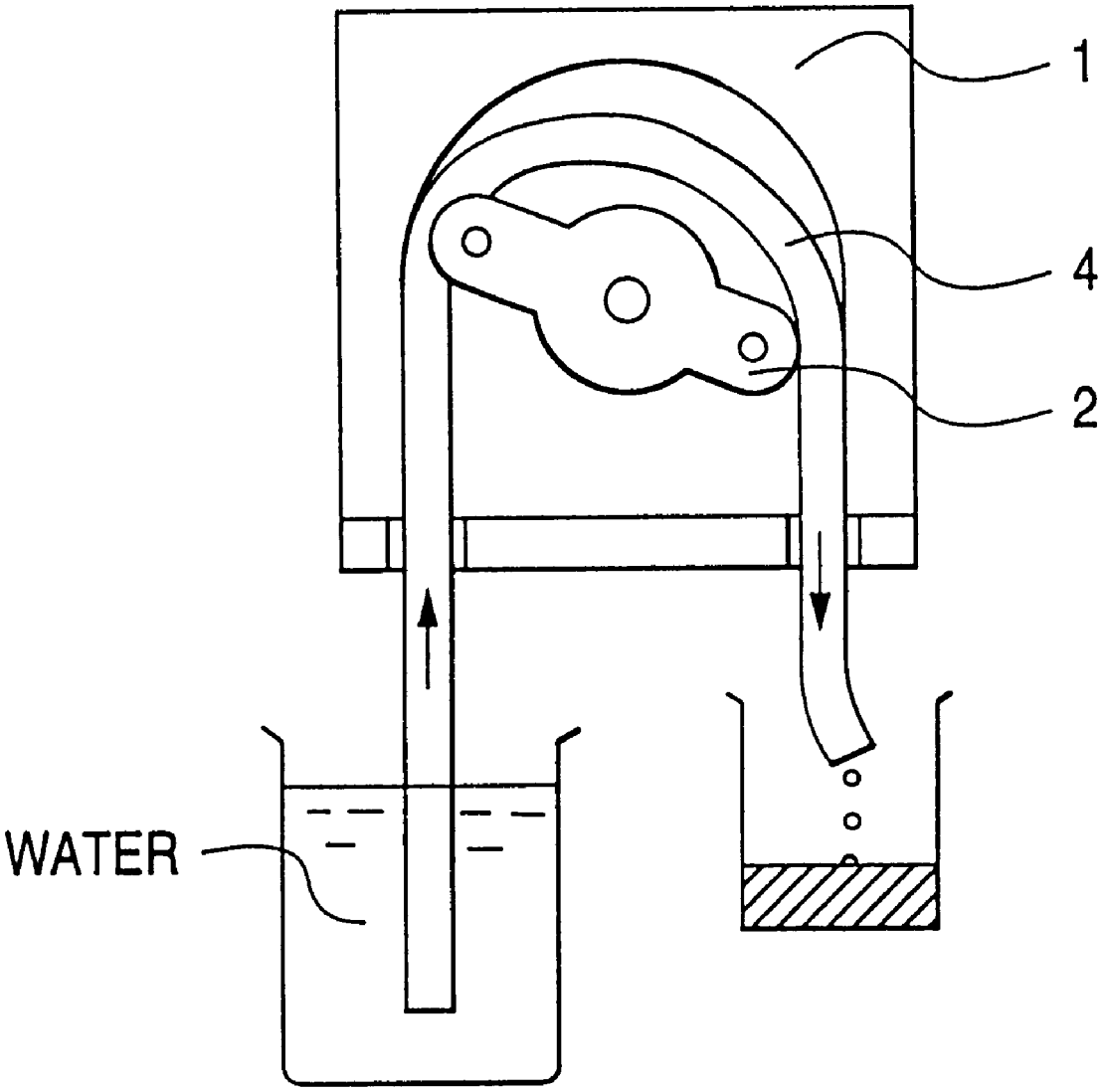
FIG. 4 is a diagram illustrative of how a discharge accuracy test is conducted.

Tests were conducted using the thus constructed pump of the present invention under dimensional conditions (the outer diameter, inner diameter, and the distance between the shaft center of the rotor and the axis of a tube) similar to those set in the case of FIG. 4. As a result, the maximum discharge error was controlled within 4%. It may be noted that in addition to blood plasma cleaners, a similar roller pump can be applied to, e.g., all types of devices such as artificial dialysis devices that require replacement of a tube every time the tube is used.

Further, while the connector has a collar in the aforementioned mode of embodiment, the shape of the connector is not limited to this example, but may be designed arbitrarily. Any shape can be selected as long as the movement of the connectors can be regulated so that a tube connected to the connectors is neither separated nor expanded from the stator. Still further, an example in which two rollers are disposed at an interval of 180° at the end portions of the rotor has been shown in the drawing in the aforementioned mode of embodiment, the present invention may be applied to embodiments in which three rollers disposed at an interval of 120° or four rollers at an interval of 90° are employed.

As described in the foregoing, the present invention, which is applied to a tube type roller pump, is characterized as regulating movement of tube connectors using a regulating member disposed on a main body that constitutes a stator. As a result of this construction, separation and expansion of a tube from the stator can be prevented, which in turn provides a tube type roller pump with high discharge accuracy.

What is claimed is:

1. A tube type roller pump comprising, a stator, an elastic tube to which two tube connectors are fixed at a predetermined interval, and a drawing roller, wherein said tube type pump further comprises a pair of regulation grooves formed in said stator; said tube connectors have an outer diameter smaller than an inner diameter of said regulation grooves, respectively; and said tube connectors are permitted to move in a traveling direction of said elastic tube thereby preventing an elastic elongation of said elastic tube in said traveling direction when said drawing roller rolls on said elastic tube between said tube connectors.

2. A tube roller pump according to claim 1, wherein each of said grooves has a smaller diameter portion and a larger diameter portion and interengages with a larger diameter portion and a smaller diameter portion, respectively, on each of said tube connectors.

* * * * *